US008555536B2

(12) United States Patent
Steichen et al.

(10) Patent No.: US 8,555,536 B2
(45) Date of Patent: Oct. 15, 2013

(54) ART FRAMES

(75) Inventors: Christine E Steichen, Escondido, CA (US); Julio Cesar Alonso, Temecula, CA (US); Xulong Fu, San Diego, CA (US); Xiaoqi Zhou, San Diego, CA (US); David Edmondson, San Diego, CA (US); Ronald J Selensky, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 30 days.

(21) Appl. No.: 13/371,136

(22) Filed: Feb. 10, 2012

(65) Prior Publication Data

US 2013/0205631 A1 Aug. 15, 2013

(51) Int. Cl.
*A47G 1/06* (2006.01)

(52) U.S. Cl.
USPC ..... 40/786; 40/782

(58) Field of Classification Search
USPC ..... 40/782, 783, 784, 785; 206/453
See application file for complete search history.

(56) References Cited

U.S. PATENT DOCUMENTS

| | | | | | |
|---|---|---|---|---|---|
| 1,913,110 | A | * | 6/1933 | Engel | 40/778 |
| 2,085,097 | A | | 6/1937 | Hansen | |
| 2,146,318 | A | * | 2/1939 | Viscount | 40/786 |
| RE22,683 | E | | 10/1945 | Piper | |
| 2,851,208 | A | | 9/1958 | Samsing | |
| 3,053,001 | A | | 9/1962 | Allen | |
| 3,214,855 | A | | 11/1965 | Winkler et al. | |
| 3,240,130 | A | | 3/1966 | Neff | |
| 3,733,809 | A | | 5/1973 | Reiter et al. | |
| 4,112,604 | A | | 9/1978 | Ott et al. | |
| 4,279,087 | A | | 7/1981 | Crawford | |
| 4,738,041 | A | | 4/1988 | Drueck, Jr. | |
| 4,870,766 | A | | 10/1989 | Topping | |
| 5,032,436 | A | | 7/1991 | Gustafson | |
| 5,076,432 | A | * | 12/1991 | Wolf et al. | 206/449 |
| 5,255,458 | A | | 10/1993 | Piel | |

(Continued)

FOREIGN PATENT DOCUMENTS

| | | |
|---|---|---|
| DE | 3701293 | 4/1988 |
| GB | 589621 | 6/1947 |

(Continued)

OTHER PUBLICATIONS

Yang, H., "Fundamentals, Preparation , and Characterization of Superhydrophobic Wood Fiber Products", Thesis, 2008, Georgia Institute of Technology, 95 pages.

*Primary Examiner* — Casandra Davis

(57) ABSTRACT

An art frame includes a three-dimensional supporting frame, which includes an image receiving surface and an opposed back surface, a center portion defining a perimeter, and at least three foldable extensions extending from the perimeter. Each foldable extension includes two folds to be folded toward the back surface to form a frame portion. Abutting frame portions form respective corners of the three-dimensional supporting frame. A corner mount is to be inserted into the abutting frame portions at the respective corners. Each corner mount includes first and second opposed surfaces, a shaped portion, and two corner mount foldable extensions extending from two sides of the shaped portion. Each corner mount foldable extension includes two tabs to be folded toward the first opposed surface. An adhesive layer is established on the second opposed surface and is to be adhered to the back surface of the three-dimensional supporting frame at the respective corners.

15 Claims, 5 Drawing Sheets

(56) References Cited

U.S. PATENT DOCUMENTS

| | | | |
|---|---|---|---|
| 5,359,794 | A | 11/1994 | Wood |
| 5,513,455 | A | 5/1996 | Walker |
| 5,678,339 | A | 10/1997 | Marventano |
| 5,679,145 | A | 10/1997 | Andersen et al. |
| 5,683,772 | A | 11/1997 | Andersen et al. |
| 5,947,437 | A | 9/1999 | Tate et al. |
| 5,950,341 | A | 9/1999 | Cross |
| 5,974,714 | A | 11/1999 | Jones |
| 6,177,516 | B1 | 1/2001 | Hudak |
| 6,265,037 | B1 | 7/2001 | Godavarti et al. |
| 6,427,371 | B2 | 8/2002 | Olson et al. |
| 6,475,713 | B1 | 11/2002 | Aylward et al. |
| 6,541,852 | B2 | 4/2003 | Beroz et al. |
| 6,649,245 | B2 | 11/2003 | Lenderink |
| 6,883,908 | B2 | 4/2005 | Young et al. |
| 7,818,904 | B2 | 10/2010 | Wagner |
| 7,851,391 | B2 | 12/2010 | Bond et al. |
| 7,918,047 | B1 | 4/2011 | Ngan |
| 2002/0144445 | A1 | 10/2002 | Gomez del Campo Diaz Barrerio |
| 2003/0129361 | A1 | 7/2003 | Plug et al. |
| 2004/0159031 | A1 | 8/2004 | Chang |
| 2006/0189236 | A1 | 8/2006 | Davis et al. |
| 2009/0229157 | A1 | 9/2009 | Mehler |
| 2010/0196603 | A1 | 8/2010 | Ohshima et al. |
| 2011/0016759 | A1 * | 1/2011 | Ramos-Gonzalez et al. ... 40/773 |
| 2011/0088294 | A1 | 4/2011 | Docking |

FOREIGN PATENT DOCUMENTS

| | | | |
|---|---|---|---|
| GB | 726212 | | 3/1955 |
| GB | 1040995 | | 9/1966 |
| GB | 1439323 | | 6/1976 |
| GB | 2104378 | | 3/1983 |
| GB | 2220854 | | 1/1990 |
| GB | 2296866 | | 7/1996 |
| GB | 2376916 | | 12/2002 |
| GB | 2441052 | A * | 2/2008 |
| GB | 2447918 | A * | 10/2008 |
| GB | 2461863 | | 1/2010 |

* cited by examiner

ART FRAMES

BACKGROUND

The present disclosure relates generally to art frames.

The global print market is in the process of transforming from analog printing to digital printing. Inkjet printing and electrophotographic printing are examples of digital printing techniques. These printing techniques have become increasingly popular for printing photographs and/or decorative art items. As examples, an image may be inkjet printed on canvas and then mounted on a wood frame, or an image may be liquid electro-photographically printed on a high gloss medium and then mounted on a metal plate.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Examples of the art frame disclosed herein are suitable for displaying photographs, art images, graphics, text, and/or the like, and/or combinations thereof. The art frames include corner mounts that are secured to respective corners of a three-dimensional supporting frame. In other words, the corner mounts are secured to places/angles where two frame portions of the three-dimensional supporting frame meet. The corner mounts add strength to the art frame.

Figure 1A:
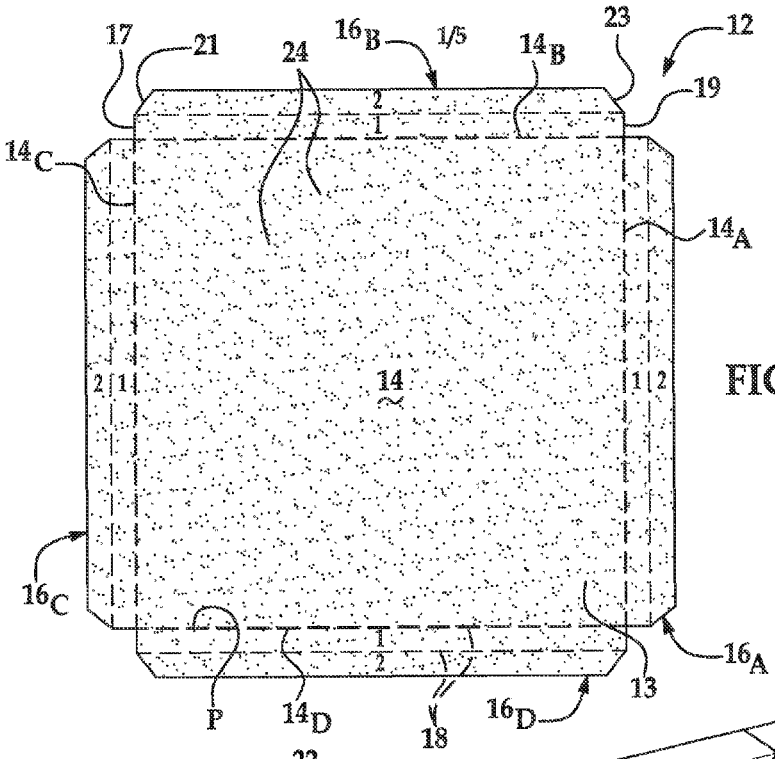
FIG. 1A is a front view of an example of a foldable material used to form an example of a three-dimensional supporting frame.

Referring now to FIG. 1A, an example of a foldable material 12 is depicted. The foldable material 12 is pre-cut and scored so that when it is folded, it forms the three-dimensional supporting frame 20 (see FIG. 1B). While the foldable material 12 shown in FIG. 1A is used to make a square three-dimensional supporting frame 20, it is to be understood that foldable material 12 may be pre-cut and scored to have any desirable shape. As examples, the foldable material 12 may be shaped so that when folded, any of the following three-dimensional supporting frames is formed: a rectangular three-dimensional supporting frame, a triangular three-dimensional supporting frame (20' in FIGS. 4A and 4B), or a polygonal three-dimensional supporting frame (20" in FIG. 5).

FIG. 1A is a front view of the foldable material 12, which has a center portion 14 that includes four sides $\mathbf{14}_A$, $\mathbf{14}_B$, $\mathbf{14}_C$, $\mathbf{14}_D$ which define a perimeter P. When the center portion 14 has four sides $\mathbf{14}_A$, $\mathbf{14}_B$, $\mathbf{14}_C$, $\mathbf{14}_D$, the center portion 14 may be square or rectangular. When the center portion 14 has three sides, the shape of the center portion is a triangle, and when the center portion 14 has more than four sides, the shape of the center portion 14 will depend upon the number of sides (e.g., five sides correspond with a pentagon shaped center portion 14, six sides correspond with a hexagon shaped center portion 14, etc.).

The foldable material 12 also has two opposed surfaces, namely an image receiving surface 13 and a back surface 15 (FIG. 1B) that is opposed to the image receiving surface 13.

A foldable extension $\mathbf{16}_A$, $\mathbf{16}_B$, $\mathbf{16}_C$, $\mathbf{16}_D$ respectively extends from each side $\mathbf{14}_A$, $\mathbf{14}_B$, $\mathbf{14}_C$, $\mathbf{14}_D$ of the center portion 14. As such, the number of foldable extensions $\mathbf{16}_A$, $\mathbf{16}_B$, $\mathbf{16}_C$, $\mathbf{16}_D$ of the foldable material 12 will depend upon the number of sides $\mathbf{14}_A$, $\mathbf{14}_B$, $\mathbf{14}_C$, $\mathbf{14}_D$. For example, a three sided center portion 14 will include three foldable extensions $\mathbf{16}_A$, $\mathbf{16}_B$, $\mathbf{16}_C$ extending therefrom. The foldable extensions $\mathbf{16}_A$, $\mathbf{16}_B$, $\mathbf{16}_C$, $\mathbf{16}_D$ may be scored with fold lines 18 that are meant to guide the folding of the foldable extensions $\mathbf{16}_A$, $\mathbf{16}_B$, $\mathbf{16}_C$, $\mathbf{16}_D$ toward the back surface 15 of the foldable material 12. In an example, each foldable extension $\mathbf{16}_A$, $\mathbf{16}_B$, $\mathbf{16}_C$, $\mathbf{16}_D$ has no less than two fold lines 18 defining no less than two folds. In the example shown in FIG. 1A, there are two folds 1, 2. In this example then, each foldable extension $\mathbf{16}_A$, $\mathbf{16}_B$, $\mathbf{16}_C$, $\mathbf{16}_D$ is foldable twice, once along each scored fold line 18. Throughout the description the fold 1 may be referred to as the innermost fold (i.e., the fold 1 closest to the perimeter P), and the fold 2 may be referred to as the outermost fold (i.e., the fold 2 furthest from the perimeter P). In other examples, it is to be understood that more than two fold lines 18 may be included on any one foldable extension $\mathbf{16}_A$, $\mathbf{16}_B$, $\mathbf{16}_C$, $\mathbf{16}_D$ so that the foldable extension $\mathbf{16}_A$, $\mathbf{16}_B$, $\mathbf{16}_C$, $\mathbf{16}_D$ is foldable more than two times.

Figure 1B:
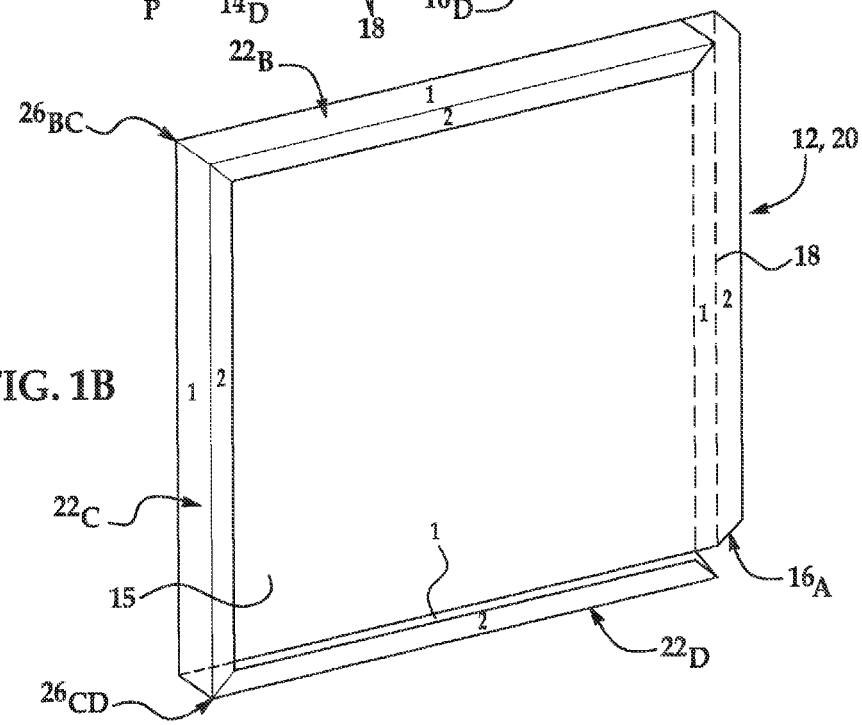
FIG. 1B is a back, perspective view of an example of the foldable material of FIG. 1A partially folded to form three frame portions and two corners of the three-dimensional supporting frame.

The foldable extensions $\mathbf{16}_A$, $\mathbf{16}_B$, $\mathbf{16}_C$, $\mathbf{16}_D$ and the folds 1, 2 may have any suitable shape that allows the folds 1, 2 of the respective foldable extension $\mathbf{16}_A$, $\mathbf{16}_B$, $\mathbf{16}_C$, $\mathbf{16}_D$ to be folded toward the surface 15 to form a three-dimensional frame portion (see $\mathbf{22}_B$ and $\mathbf{22}_C$ in FIG. 1B). Each of the foldable extensions $\mathbf{16}_A$, $\mathbf{16}_B$, $\mathbf{16}_C$, $\mathbf{16}_D$ is partially angled at opposed edges so that when the folds 1, 2 are folded, the resulting frame portion $\mathbf{22}_A$, $\mathbf{22}_B$, $\mathbf{22}_C$, and $\mathbf{24}_D$ abuts an adjacent frame portion (see FIGS. 1B and 3A).

As shown in FIG. 1A, the innermost fold 1 of each foldable extension $\mathbf{16}_A$, $\mathbf{16}_B$, $\mathbf{16}_C$, $\mathbf{16}_D$ has opposed edges 17, 19 that are perpendicular with respect to the respective side $\mathbf{14}_A$, $\mathbf{14}_B$, $\mathbf{14}_C$, $\mathbf{14}_D$ of the center portion 14 from which the foldable extension $\mathbf{16}_A$, $\mathbf{16}_B$, $\mathbf{16}_C$, $\mathbf{16}_D$ extends. Said another way, the innermost fold 1 has opposed edges 17, 19 that are perpendicular with respect to the perimeter P at the respective foldable extension $16_A$, $16_B$, $16_C$, $16_D$. For example, edges 17 and 19 of foldable extension $16_B$ are each perpendicular to the side $14_B$ (i.e., to the perimeter P at the extension $16_B$). Also as shown in FIG. 1A, the outermost fold 2 of each foldable extension $16_A$, $16_B$, $16_C$, $16_D$ has opposed edges 21, 23 that are angled with respect to the respective side $14_A$, $14_B$, $14_C$, $14_D$ of the center portion 14 from which the foldable extension $16_A$, $16_B$, $16_C$, $16_D$ extends. Said another way, the outermost fold 2 has opposed edges 21, 23 that are angled with respect to the perimeter P at the respective foldable extension $16_A$, $16_B$, $16_C$, $16_D$. As examples, edge 21 of foldable extension $16_B$ is angled about 45° with respect to the side $14_B$ (i.e., to the perimeter P at the extension $16_B$), and edge 23 of foldable extension $16_B$ is angled about 135° with respect to the side $14_B$ (i.e., to the perimeter P at the extension $16_B$). The angles of the edges 21, 23 of the outermost folds 2 may change when the foldable material 12 has a different number of foldable extensions $16_A$, $16_B$, $16_C$, $16_D$. Any desirable angle may be used, as long as adjacent edges 21, 23 abut one another when the foldable material 12 is folded to form the three-dimensional frame portions.

The foldable material 12 may be made of any foldable material with suitable stiffness that can be folded over at least 90° with the assistance of scoring without cracking and/or breaking. When the foldable material 12 is a cellulose-based paper board, the stiffness of the foldable material 12 is greater than 25 Taber units (gf-cm). In an example, the stiffness of the foldable material 12 ranges from about 100 Taber units to about 3000 Taber units (TAPPI method T489-om). In another example, the stiffness of the foldable material 12 ranges from about 500 Taber units to about 2000 Taber units (TAPPI method T489-om). Stiffness, k, of a body is a measure of the resistance offered by an elastic body to deformation. For an elastic body with a single degree of freedom (for example, stretching or compression of a rod), the stiffness, k, is defined as $$k = \frac{F}{\delta}$$

where F is the force applied on the body and δ is the displacement produced by the force along the same degree of freedom. Examples of the foldable material 12 include pure element materials, such as aluminum foil; compounds of multiple elements, such as copper-zinc alloy foil; synthetic polymers, such as polyvinyl chloride, polyethylene terephthalate (PET), toughened polypropylene; natural products, such as cellulose paper (e.g., cardboard); or composites, such as polyethylene terephthalate/calcium carbonate (PET/$CaCO_3$) coextruded sheets. Other examples of the foldable material 12 include carton board (e.g., solid bleached board, solid unbleached board), white lined chipboard, liquid packaging board, folding boxboard, container board (e.g., liner board), wall paper substrates, uncoated cover paper, or the like.

Still another example of the foldable material 12 is a multi-layer material formed using standard paper mill processes. It is to be understood that the various layers of a multi-layer foldable material 12 may be sandwiched together using a polymeric adhesive or chemically treated starch.

In an example, foldable material 12 has three layers, a corrugated middle layer and two outer layers attached to opposed sides of the corrugated middle layer. Each of the layers may include a cellulose fiber matrix. The cellulose fiber matrix present in each of the layers (i.e., the outer layers and the corrugated layer) of the foldable material 12 may be made up of fibers from a hardwood species, fibers from a softwood species, or a combination of fibers from both hardwood and softwood species. Examples of hardwood species include broadleaf deciduous trees, and an example of a softwood species includes needle-bearing, conifer trees and evergreens. The hardwood cellulose fibers used in the cellulose fiber matrix have an average fiber length ranging from about 0.5 mm to about 3 mm, and the softwood cellulose fibers have an average fiber length ranging from about 3 mm to about 7 mm. A ratio of hardwood fibers to softwood fibers in the cellulose fiber matrix of any individual layer of the composite board may range from 0:100 to 50:50. In some examples, the ratio of hardwood fibers to softwood fibers is about 30:70 or about 10:90.

The cellulose fibers present in the outer layers are made from a chemical pulping process (e.g., the Kraft process). The chemical pulping process forms chemical pulp. The wood lignin in chemical pulp is broken and separated by heat and chemicals used in the chemical pulping process.

The cellulose fibers present in the corrugated layer may be mechanical pulp or a mixture of mechanical pulp with chemical pulp or recycled pulps. Chemical pulp is formed as previously described. Mechanical pulp may be formed by steaming and grinding wood to separate the fibers and obtain groundwood pulp that contains lignin. Mechanical pulp may include pulps formed using hybrid processes, such as thermomechanical pulp (TMP) and chemithermomechanical pulps (CTMP).

In an example, the foldable material has a thickness greater than or equal to 8 mils, and/or a base weight that is greater than or equal to 150 gsm.

As shown in FIG. 1A, an adhesive layer 24 is applied on the image receiving surface 13 at least at the center portion 14. In FIG. 1A, the speckles are used to illustrate the adhesive layer 24. The adhesive layer 24 may be applied anywhere on the surface 13 that it is desirable to adhere an image receiving medium (reference numeral 36 in FIG. 3C). As examples, the adhesive layer 24 may be applied to the center portion 14 alone, or to the center portion 14 and each of the folds 1, or to the center portion 14 and each of the folds 1 and 2 (as shown in FIG. 1A). The adhesive layer 24 may be applied to the center portion 14 and each of the folds 1 or the folds 1 and 2 when it is desirable that the image receiving medium 36 be folded with folds 1, or folds 1 and 2. In these instances, the image receiving medium 36 may have the same shape and size as the center portion 14 and the folds 1 or the folds 1 and 2 of the foldable material 12.

The adhesive layer 24 may be applied to the surface 13 on the desirable areas using an air knife coater, a rod coater, a slot die coater, a roll coater, or a film transfer coater. In one example, the adhesive layer 24 may be applied directly onto a release liner (not shown, also referred to herein as a releasable liner), and then the glued release liners may be laminated onto the desired areas of the surface 13 using a laminator. The release liner may protect the adhesive layer 24 from contamination and from prematurely adhering.

The adhesive layer 24 may be a solvent-based adhesive or a water-based adhesive. Solvents suitable for the solvent-based adhesive include heptanes, toluene, ethyl acetate, pentane-2,4-dione, and alcohols. In some instances, it may be desirable to utilize an aqueous-based water soluble and/or water dispersible adhesive. In an example, the adhesive layer 24 is formed of a synthetic polymer with a weight average molecular weight ranging from about 200,000 to about 800,000 when the structure is linear, or ranging from about 300,000 to about 1,500,000 when the structure is branched or cross-linked. The adhesive layer 24 may also have a pressure sensitive nature. For example, the adhesive layer 24 may have a glass transition temperature ($T_g$) ranging from about −70° C. to about −40° C., and a peeling strength equal to or greater than 20 Newton/cm$^2$ (e.g., as measured according to an ASTM (f.k.a. the American Society for Testing and Materials) test method, namely ASTM 3330M using an INSTRON® tester).

Suitable examples of the adhesive layer 24 are polyacrylates, polyvinyl ethers, silicone resins, polyacrylic resins, elastic hydrocarbon polymers (e.g., nitrile rubbers, butyl rubbers, polyisobutylenes and polyisoprenes, etc.), ethylene-vinyl acetate copolymers, or styrene block copolymers (e.g., styrene-butadiene-styrene (SBS), styrene-ethylene-styrene, styrene-butylene-styrene, styrene-ethylene, or styrene-propylene). Some suitable adhesives for the adhesive layer 24 may be polymers of acrylate addition monomers, such as C1 to C12 alkyl acrylates and methacrylates (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl acrylate, methyl methacrylate, ethyl methacrylate, n-propyl methacrylate, isopropyl methacrylate, n-butyl methacrylate, isobutyl methacrylate, sec-butyl methacrylate, and tert-butyl methacrylate); aromatic monomers (e.g., styrene, phenyl methacrylate, o-tolyl methacrylate, m-tolyl methacrylate, p-tolyl methacrylate, and benzyl methacrylate); hydroxyl containing monomers (e.g., hydroxyethylacrylate and hydroxyethylmethacrylate); carboxylic acid containing monomers (e.g., acrylic acid and methacrylic acid); vinyl ester monomers (e.g., vinyl acetate, vinyl propionate, vinylbenzoate, vinyl pivalate, vinyl-2-ethylhexanoate, and vinyl-versatate); vinyl benzene monomers; and C1-C12 alkyl acrylamide and methacrylamide (e.g., t-butyl acrylamide, sec-butyl acrylamide, N,N-dimethylacrylamide). In another example, the adhesive layer 24 includes a compound having a structure of unsaturated rings. Examples of such compounds include glycerol ester of abietic acid, pentaerythritol ester of abietic acid, and terpene resins derived from alfa-pinene and beta-pinene.

The adhesive layer 24 may be a copolymer of at least two of the monomers listed herein. In an example, the molecular structure of the formed copolymer has soft segments ($T_g$ ranging from about −70° C. to about −20° C.) and small hard segments ($T_g$ ranging from about −10° C. to about 100° C.). The copolymer may also include functional monomers, i.e., the chemical groups on the molecular chain can react to form a cross-linked structure. Examples of functional monomers include methacrylic acid, acrylic acid, glycidyl methacrylate, and hydroxyethyl acrylate.

In an example, the adhesive layer 24 is applied to have a coat weight ranging from 25 gsm to about 60 gsm. If the adhesive layer coat weight is less than 25 gsm, the bond strength will decrease and adhesion failure may result.

While the example shown in FIG. 1A has the adhesive layer 24 applied to the image receiving surface 13 of the foldable material 12, it is to be understood that the adhesive layer 24 may also be applied to the back surface of the image receiving medium 36. In these instances, the adhesive layer 24 on the image receiving medium 36 adheres the image receiving medium 36 to the image receiving surface 13, for example, at the center portion 14, the center portion 14 and the folds 1, or the center portion 14 and the folds 1, 2.

Referring now to FIG. 1B, an example of the foldable material 12 of FIG. 1A is shown partially folded. It is to be understood that when folding is complete, the three-dimensional supporting frame 20 is formed. When the foldable extensions $\mathbf{16}_A$, $\mathbf{16}_B$, $\mathbf{16}_C$, $\mathbf{16}_D$ of the foldable material 12 are folded, respective three-dimensional frame portions $\mathbf{22}_A$, $\mathbf{22}_B$, $\mathbf{22}_C$, $\mathbf{22}_D$ are formed. Three of these frame portions $\mathbf{22}_B$, $\mathbf{22}_C$, $\mathbf{22}_D$ are shown in FIG. 1B. As depicted, the frame portion $\mathbf{22}_C$ abuts frame portions $\mathbf{22}_B$ and $\mathbf{22}_D$ at opposed ends to form two corners $\mathbf{26}_{BC}$ and $\mathbf{26}_{CD}$ of the three-dimensional supporting frame 20. Similarly, when the foldable extension $\mathbf{16}_A$ is folded, corners $\mathbf{26}_{AB}$ and $\mathbf{26}_{DA}$ will be formed (see FIG. 3A).

To construct the three-dimensional supporting frame 20, fold 1 of each of the extensions $\mathbf{16}_A$, $\mathbf{16}_B$, $\mathbf{16}_C$, $\mathbf{16}_D$ is folded inward (i.e., towards the surface 15). The fold 1 of a respective extension $\mathbf{16}_A$, or $\mathbf{16}_B$, or $\mathbf{16}_C$, or $\mathbf{16}_D$ forms an outer wall of the respective frame portion $\mathbf{22}_A$, $\mathbf{22}_B$, $\mathbf{22}_C$, $\mathbf{22}_D$. All together, the folds 1 form the outer wall of the three-dimensional supporting frame 20. In some instances, the outer wall may be covered by a portion of the image receiving medium 36. Fold 2 of each of the extensions $\mathbf{16}_A$, $\mathbf{16}_B$, $\mathbf{16}_C$, $\mathbf{16}_D$ is also folded inward (i.e., towards the surface 15). The fold 2 of a respective extension $\mathbf{16}_A$, or $\mathbf{16}_B$, or $\mathbf{16}_C$, or $\mathbf{16}_D$ forms a back wall of the respective frame portion $\mathbf{22}_A$, $\mathbf{22}_B$, $\mathbf{22}_C$, $\mathbf{22}_D$. All together, the folds 2 form the back wall of the three-dimensional supporting frame 20. In some instances, the back wall may also be covered by a portion of the image receiving medium 36.

Referring now to FIGS. 2A through 2D, different examples of a blank 28, 28', 28", 28'" that may be folded to form a corner mount 40 (shown in FIG. 2E) are depicted. A single corner mount 40 is to be inserted into the respective corners $\mathbf{26}_{AB}$, $\mathbf{26}_{BC}$, $\mathbf{26}_{CD}$, $\mathbf{26}_{DA}$ of the three-dimensional supporting frame 20.

FIGS. 2A-2D are front views of the blanks 28, 28', 28", 28'". The blanks 28, 28', 28", 28'" have two opposed surfaces, namely a first surface 27 and a second surface 29 that is opposed to the first surface 27.

Figure 2A:
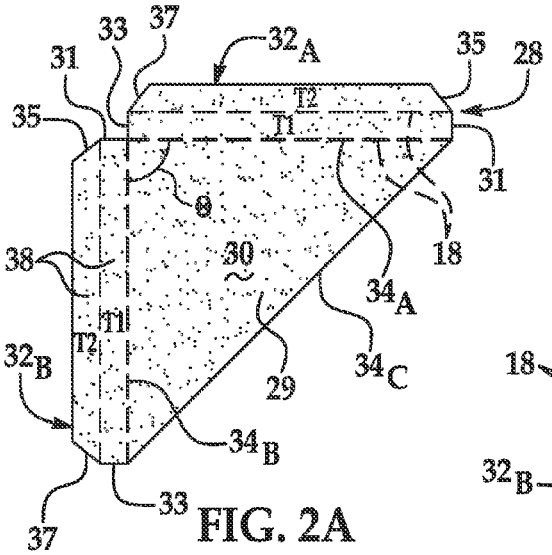
FIGS. 2A through 2D are front views of examples of different blanks used to form different examples of a corner mount.
Figure 2B:
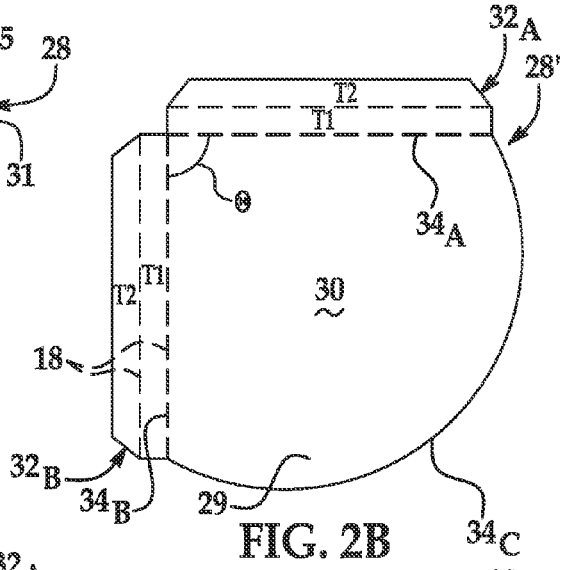
Figure 2C:
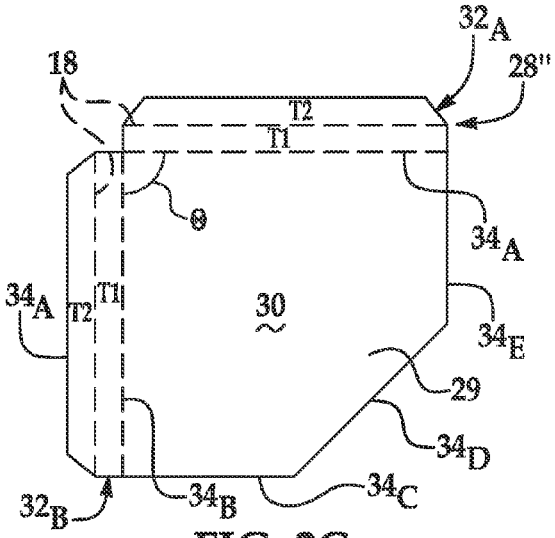
Figure 2D:
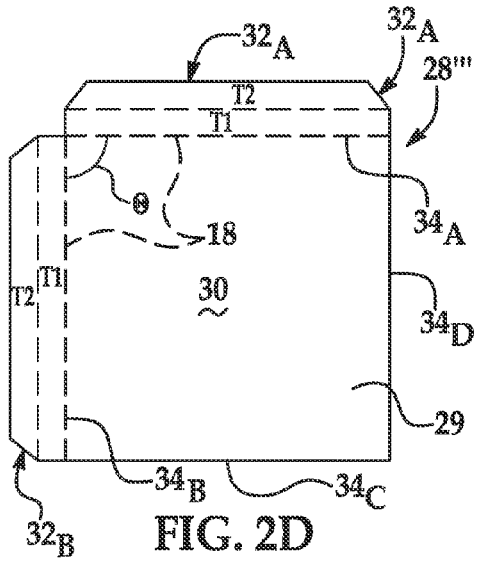

Each blank 28, 28', 28", 28'" includes a shaped portion 30 that has two sides $\mathbf{34}_A$, $\mathbf{34}_B$ having corner mount foldable extensions $\mathbf{32}_A$, $\mathbf{32}_B$ extending therefrom, and one or more additional sides (e.g., $\mathbf{34}_C$ in FIGS. 2A and 2B, $\mathbf{34}_C$, $\mathbf{34}_D$, and $\mathbf{34}_E$ in FIG. 2C, and $\mathbf{34}_C$ and $\mathbf{34}_D$ in FIG. 2D). The two sides $\mathbf{34}_A$, $\mathbf{34}_B$ meet at an angle θ that is complementary to the angle of the respective corners $\mathbf{26}_{AB}$, $\mathbf{26}_{BC}$, $\mathbf{26}_{CD}$, $\mathbf{26}_{DA}$ of the three-dimensional supporting frame 20. In some instances, the angle θ is a 90° angle, and in other instances, the angle θ is an acute angle (see FIG. 4B) or an obtuse angle (see FIG. 5), the degree of which depends, at least in part, on the angle of the corners $\mathbf{26}_{AB}$, $\mathbf{26}_{BC}$, $\mathbf{26}_{CD}$, $\mathbf{26}_{DA}$ of the three dimensional supporting frame 20.

All of the sides $\mathbf{34}_A$, $\mathbf{34}_B$, $\mathbf{34}_C$, etc. together define the shape of the shaped portion 30. As shown in FIGS. 2A through 2D, the shaped portion 30 may be a triangle (FIG. 2A), a circular sector (FIG. 2B), a polygon having five or more sides (FIG. 2C), or a square or rectangle (FIG. 2D). Other shapes not mentioned are also contemplated as being suitable for the shaped portion 30.

Each of the corner mount foldable extensions $\mathbf{32}_A$, $\mathbf{32}_B$ extending from the respective sides $\mathbf{34}_A$, $\mathbf{34}_B$ may be scored with fold lines 18 that are meant to guide the folding of the corner mount foldable extensions $\mathbf{32}_A$, $\mathbf{32}_B$ toward the first surface 27 of the blank 28, 28', 28", 28'". In an example, each corner mount foldable extension $\mathbf{32}_A$, $\mathbf{32}_B$ has two fold lines 18 defining two tabs T1, T2. In this example, each corner mount foldable extension $\mathbf{32}_A$, $\mathbf{32}_B$ is foldable twice, once along each scored fold line 18. Throughout the description the tab T1 may be referred to as the innermost tab (i.e., the tab T1 closest to the shaped portion 30), and the tab T2 may be referred to as the outermost tab (i.e., the tab T2 furthest from the shaped portion 30).

Figure 2E:
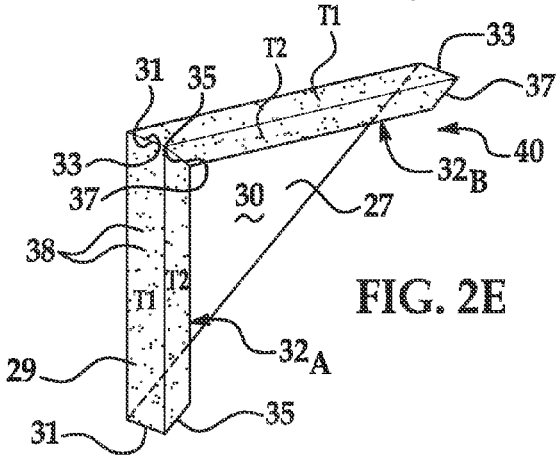
FIG. 2E is a back, perspective view of an example of the blank of FIG. 2A folded to form an example of the corner mount.

The corner mount foldable extensions $\mathbf{32}_A$, $\mathbf{32}_B$ and the tabs T1, T2 may have any suitable shape that allows the tabs T1, T2 of the respective corner mount foldable extension $32_A$, $32_B$ to be folded toward the surface 27 to form the corner mount 40 (see FIG. 2E). When folded, the tabs T1 abut one another to form an angle that is the same as the angle θ, and tabs T2 also abut one another.

As shown in FIG. 2A, the innermost tab T1 of each corner mount foldable extension $32_A$, $32_B$ has opposed edges 31, 33 that are perpendicular with respect to the respective side $34_A$, $34_B$ of the shaped portion 30 from which the foldable extension $32_A$, $32_B$ extends. For example, edges 31 and 33 of foldable extension $32_B$ are each perpendicular to the side $34_B$. When folded as shown in FIG. 2E, edge 33 of the tab T1 of the foldable extension $32_A$ abuts edge 31 of the tab T1 of the foldable extension $32_B$. Also as shown in FIG. 2A, the outermost tab T2 of each corner mount foldable extension $32_A$, $32_B$ has opposed edges 35, 37 that are angled with respect to the respective side $34_A$, $34_B$ of the shaped portion 30 from which the foldable extension $32_A$, $32_B$ extends. As examples, edge 35 of foldable extension $32_B$ is angled about 135° with respect to the side $34_B$, and edge 37 of foldable extension $32_B$ is angled about 45° with respect to the side $34_B$. When folded as shown in FIG. 2E, edge 37 of the tab T2 of the foldable extension $32_A$ abuts edge 35 of the tab T2 of the foldable extension $32_B$.

The blanks 28, 28', 28", 28'" may be made of any of the materials previously described for the foldable material 12.

As depicted in FIGS. 2A and 2E, an adhesive layer 38 is applied on the second surface 29 of the blank 28. The adhesive layer 38 is illustrated by the speckles in FIGS. 2A and 2E. While not shown in FIGS. 2B through 2D, it is to be understood that the adhesive layer 38 may be applied to the second surface 29 of these blanks 28', 28", 28'" as well. In an example, the adhesive layer 38 is applied to have a thickness ranging from about 15 μm to about 28 μm.

The adhesive layer 38 may be made of any of the adhesives previously described for the adhesive layer 24, and may be applied via any of the previously described methods. The adhesive layer 38 on the second surface 29 of the blank 28 is used at least to adhere a respective corner mount 40 to the interior of the three-dimensional supporting frame 20 at each of the corners $26_{AB}$, $26_{BC}$, $26_{CD}$, $26_{DA}$. This process will be further described in reference to FIGS. 3A and 3B. It is to be understood that a release liner (such as those previously described) may be removably positioned on the adhesive layer 38 until it is desirable to adhere the corner mount 40.

Figure 3A:
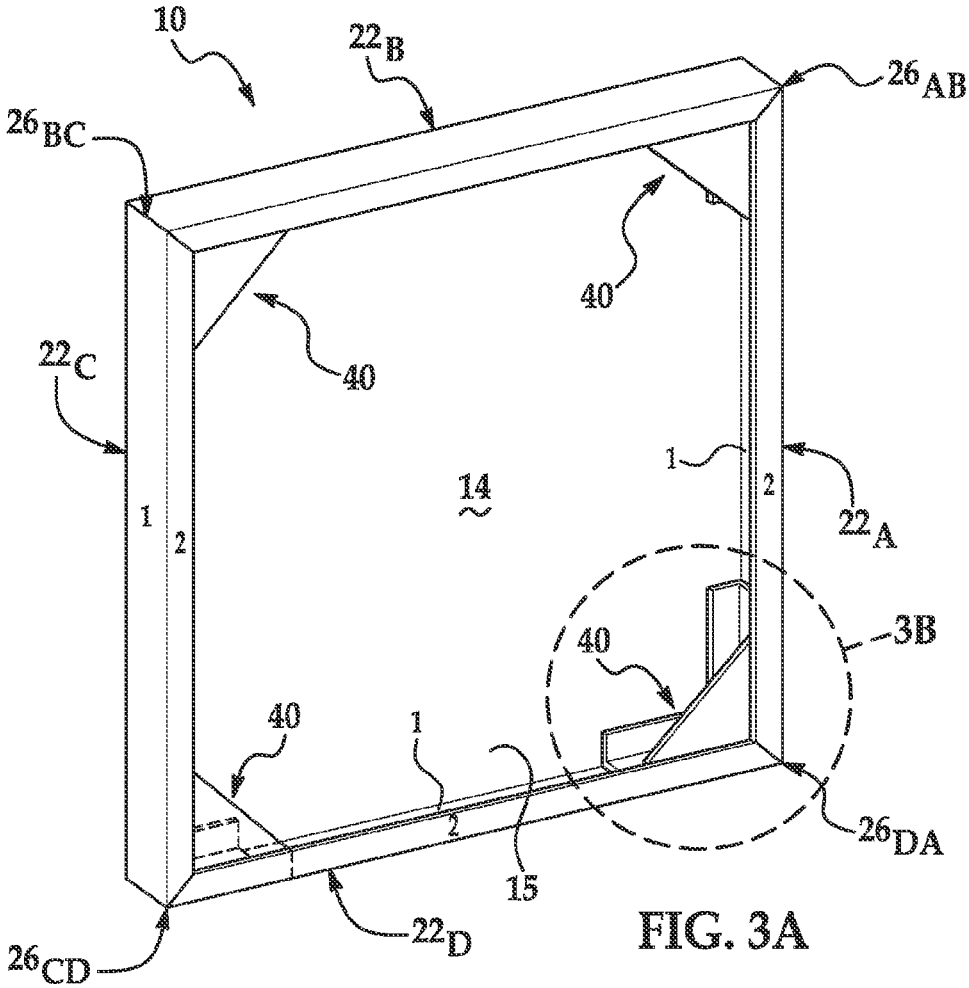
FIG. 3A is a back, perspective view of an example of an art frame including the three-dimensional supporting frame of FIG. 1B and the corner mount of FIG. 2E.
Figure 3B:
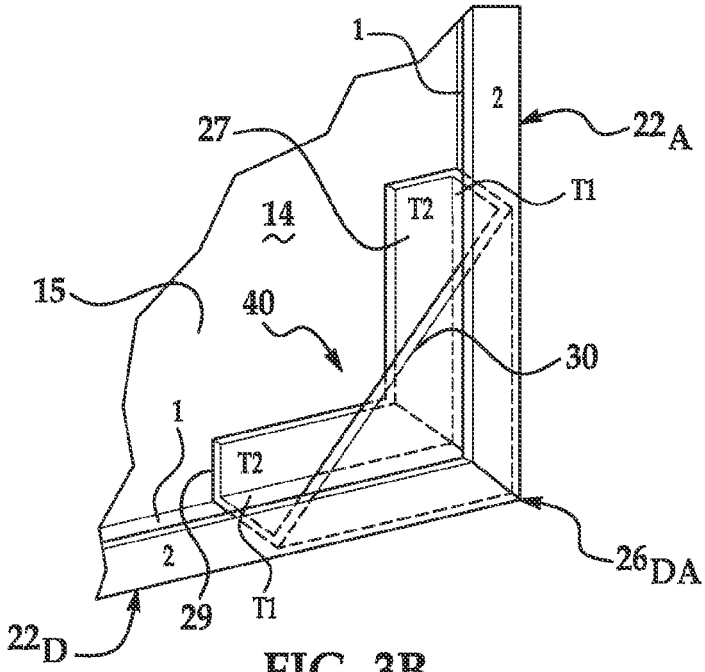
FIG. 3B is a top, back, perspective cut-away view of one of the corners of the art frame of FIG. 3A.

Referring now to FIGS. 3A and 3B, an example of the art frame 10 is depicted. As illustrated, a respective corner mount 40 is inserted into the three-dimensional supporting frame 20 so that the corner mount 40 is adhered to the back surface 15 at each of the corners $26_{AB}$, $26_{BC}$, $26_{CD}$, $26_{DA}$ of the three-dimensional supporting frame 20. In an example, the adhesive layer 38 (not shown in these figures) on the second surface 29 adheres at least some of the corner mount 40 to the three-dimensional supporting frame 20.

FIG. 3B depicts how the corner mount 40 is positioned within the corner $26_{AB}$, and illustrates which components of the corner mount 40 adhere to which components of the three-dimensional supporting frame 20. While the other corners $26_{BC}$, $26_{CD}$, $26_{DA}$ are not shown in a similar view, it is to be understood that the respective corner mounts 40 are positioned within each of these corners $26_{BC}$, $26_{CD}$, $26_{DA}$ in the same manner as will be described for the corner $26_{AB}$.

The corner mount 40 is inserted into the pocket that is defined by the abutting frame portions $22_A$ and $22_B$. Where the corner mount 40 contacts the three-dimensional supporting frame 20, it is to be understood that the back surface 15 of the foldable material 12 contacts the second surface 29 of the blank 28. The adhesive layer 38 adheres the two contacting surfaces 15 and 29 together.

The complementary angles of the corner $26_{AB}$ and the corner mount 40 are aligned when the corner mounts 40 are positioned within the corners $26_{AB}$, $26_{BC}$, $26_{CD}$, $26_{DA}$.

The outermost folds 2 of the frame portions $22_A$ and $22_B$ adhere to a portion of the shaped portion 30. As depicted, the outermost folds 2 overlay some of the shaped portion 30. The part of the shaped portion 30 that is not adhered to the outermost folds 2 is visible from the back view as shown in FIGS. 3A and 3B. A respective innermost fold 1 of the frame portions $22_A$ and $22_B$ is adhered to a respective innermost tab T1 of the corner mount 40. A respective outermost tab T2 of the corner mount 40 is adhered to an area of the center portion 14. As illustrated in FIG. 3B, the first surface 27 of the corner mount 40 does not directly contact the three-dimensional supporting frame 20.

Figure 3C:
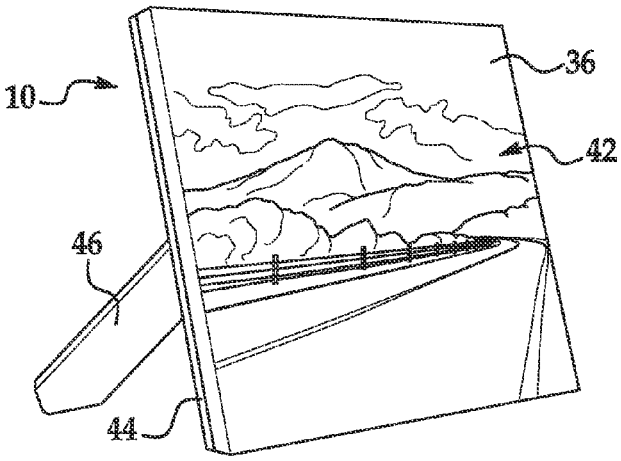
FIG. 3C is a front, perspective view of the art frame of FIG. 3A including an image receiving medium thereon and a table top support structure mounted to the three-dimensional supporting frame.

Referring now to FIG. 3C, a front, perspective view of the frame 10 is depicted. This figure illustrates the image receiving medium 36 (having an image 42 printed thereon) and a back support 44 adhered to the three-dimensional supporting frame 20.

The image receiving medium 36 may be adhered to the image receiving surface 13 of the foldable material 12 prior to folding the foldable material 12 to form the three-dimensional supporting frame 20. The image 42 may first be printed on the image receiving medium 36. When it is desirable to adhere the image receiving medium 36 to the surface 13, the image receiving medium 36 may be aligned with the foldable material 12 and pressed on the adhesive layer 24. If a release liner covers the adhesive layer 24, it is to be understood that it is removed before adhering the image receiving medium 36. Alternatively, the adhesive layer 24 may be applied to the image receiving medium 36 and then the image receiving medium 36 may be adhered to the foldable material 12. After the image receiving medium 36 is adhered, rubber rollers may be used to apply force to the adhered materials to remove any air bubbles entrapped between the adhered materials.

The image receiving medium 36 may be a foldable material which has a specific surface that is able to receive the digital image 42 with high print quality. The specific surface may be made by coating or depositing a digital ink/toner receiving layer onto the outermost surface of a base substrate. In this example, coating or depositing refers to the application of a specifically formulated chemical composition onto the outermost surface of the base substrate of the image receiving medium 36 by a suitable process which includes any type of coating process. The specific surface may also be made by surface treating the base substrate via a physical and/or chemical process (e.g., corona treatment, plasma grafting polymerization and/or acid etching). In this example, surface treating refers to a method for altering the surface structure or morphology chemically and/or physically without applying any foreign composition to cover the surface of the base substrate. The surface treating method modifies the nature of the base substrate surface by changing the surface morphology or changing the surface chemical functional groups.

In one example, the image receiving medium 36 includes a cellulose paper base, and the outermost surface of the cellulose paper base is surface functionalized with a digital ink/toner receiving layer. The composition of the digital ink/toner receiving layer may include binder(s) (e.g., water-based binders such as polyvinyl alcohol, styrene-butadiene emulsion, acrylonitrile-butadiene latex, or combinations thereof) and inorganic pigment particle(s) (e.g., clay, kaolin, calcium carbonate, or combinations thereof). The digital ink/toner receiving layer may be subjected to an embossing treatment to create a desirable surface texture which is represented by a lay pattern. "Lay" is a measure of the direction of the predominant machining pattern. A lay pattern is a repetitive impression created on the surface of a part. The lay patterns created on the image receiving medium 26 include, for example, vertical patterns, horizontal patterns, radial patterns, circular patterns, isotropic patterns and cross hatched patterns.

The image receiving medium 36 may also be a cellulose paper base that is co-extruded with a polymeric film, such as a polyolefin film or another organic polymer.

In another example, the image receiving medium 36 is made of a foldable material based on a polymeric film. Examples of suitable polymeric films include polyolefin films (e.g., polyethylene and polypropylene films), polycarbonate films, polyamide films, polytetrafluoroethylene (PTFE) films. These polymeric films can be used alone, or they can be co-extruded with another material, such as cellulose paper, to form a foldable image receiving medium. In some examples, the polymeric film surface is pre-coated with an example of the digital ink/toner receiving layer disclosed herein and/or is surface treated to improve the ink reception and toner adhesion.

In yet another example, the image receiving medium 36 is made of a foldable ductile metal foil. The metal foil may be a pure metal and/or a metal alloy. In some examples, the metal foil surface is pre-coated with an example of the digital ink/toner receiving layer disclosed herein and/or is surface treated to improve the ink reception and toner adhesion.

The image 42 may be created using any suitable digital printing technique. Examples of suitable printing techniques include digital inkjet printing (e.g., using HP Z3100 or Z3200 printers), electrophotographic printing (utilizing dry toner), liquid electrophotographic printing (utilizing liquid toner), etc.

It is believed that the durability of the printed image 42 may be the result of the combination of the medium 36 and the ink or toner that is used. For example, a medium 36 including a digital ink/toner receiving layer or having been surface treated may be desirable when digital electrophotographic printing is used with toners that contain a durable colorant and UV, light and ozone fastness resin binders. In another example, a durable printed image is formed when a pigment inkjet ink is printed, using inkjet technology, onto a microporous image receiving medium. In this example, a pigment or any number of pigment blends may be provided in the inkjet ink formulation to impart color to the ink. As such, the pigment may be any number of desired pigments dispersed throughout the resulting inkjet ink. More particularly, the pigment included in the inkjet ink may include self-dispersed (surface modified) pigments, or pigments accompanied by a dispersant.

The image receiving medium 36 may be the same shape and size as i) the center portion 14 of the foldable material 12, ii) the center portion 14 and each of the first folds 1 of the foldable extensions $\mathbf{16}_A$, $\mathbf{16}_B$, $\mathbf{16}_C$, $\mathbf{16}_D$, or iii) the entire foldable material (i.e., center portion 14 and both folds 1 and 2 of each foldable extension $\mathbf{16}_A$, $\mathbf{16}_B$, $\mathbf{16}_C$, $\mathbf{16}_D$). In the two latter instances, the image receiving medium 36 is foldable with the foldable material 12. Depending upon the size and shape of the image receiving medium 36, it is to be understood that the image receiving medium 36 may be visible from i) the front of the art frame 10, ii) the front and each side of the art frame 10, or iii) the front, each side, and the back of the art frame (unless a back support is adhered to the back).

Figure 3D:
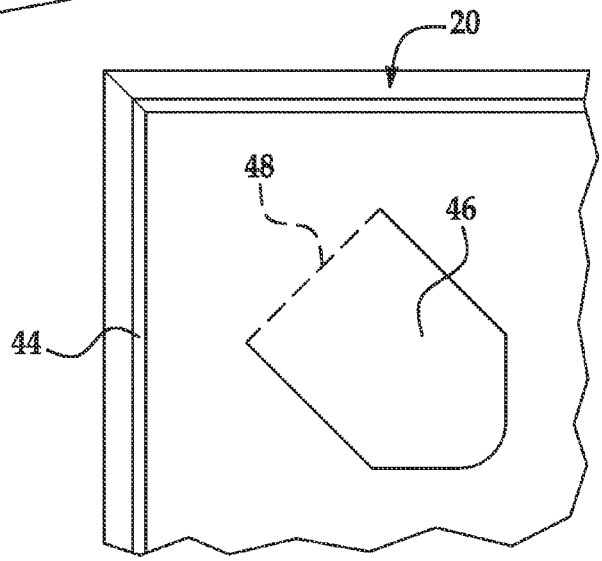
FIG. 3D is a back, perspective view of the art frame of FIG. 3C.

As illustrated in FIGS. 3C and 3D, the art frame 10 may also include a back support 44 adhered to the back wall (i.e., the outermost folds 2 on the image receiving surface 13) of the three-dimensional supporting frame 20. While not shown, it is to be understood that the back support 44 may also adhere to the part of the shaped portion 30 that is not adhered to the outermost folds 2. The back support 44 may be formed of any of the materials previously described for the foldable material 12. The back support 44 may also include a table top support structure 46 secured thereto. The table top support structure 46 may flip out away from the back support 44 (as shown in FIG. 3C) along the score line 48, while still being secure to the back support 44 at the score line 48. When flipped out, the table top support structure 46 is positioned at a desirable angle away from the back support 44 so that the structure 46 supports the art frame 10 as shown in FIG. 3C. In these instances, the art frame 10 may sit on a table top. While not shown, it is to be understood that the back support may include an aperture for hanging the art frame 10 or other hardware for hanging the art frame 10.

It is to be understood that the art frame 10 may have different shapes. As noted above, the art frame 10 may be triangular or a polygon having five or more sides. Two examples of differently shaped art frames 10 without a back support adhered thereto are depicted in FIGS. 4A and 4B and in FIG. 5.

Figure 4A:
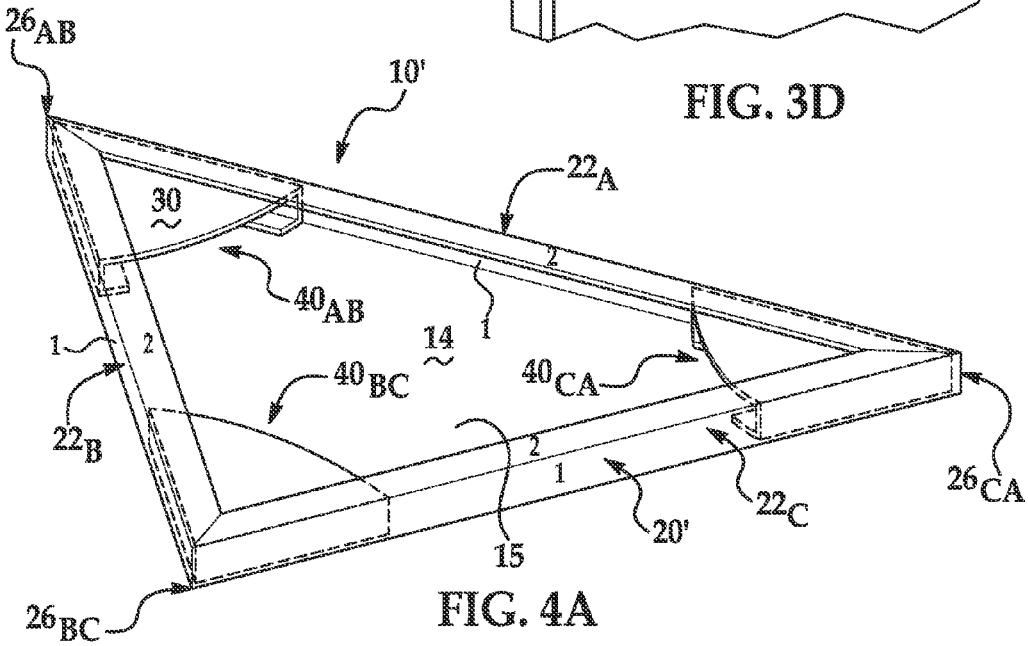
FIG. 4A is a back, perspective view of another example of an art frame.
Figure 4B:
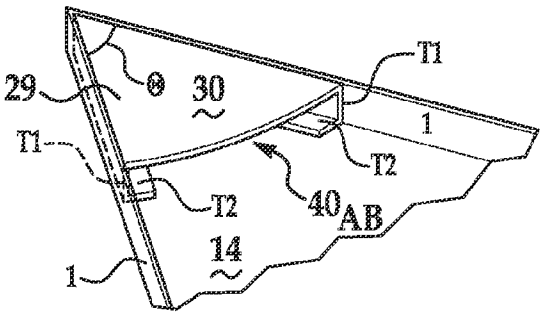
FIG. 4B is a back, perspective cut-away view of one of the corners of the art frame of FIG. 4A, with the back wall of the three-dimensional supporting frame removed for clarity.

Referring now to FIG. 4A, a triangular shaped art frame 10' is depicted. The triangular shaped art frame 10' includes a triangular shaped three-dimensional supporting frame 20' and corner mounts $\mathbf{40}_{AB}$, $\mathbf{40}_{BC}$, and $\mathbf{40}_{CA}$ inserted into the respective corners $\mathbf{26}_{AB}$, $\mathbf{26}_{BC}$, and $\mathbf{26}_{CA}$ of the three-dimensional supporting frame 20'.

The foldable material 12 used to form a triangular three-dimensional supporting frame 20' has a center portion 14 and three sides (similar to sides $\mathbf{14}_A$, $\mathbf{14}_B$, etc.). Extending from each of the three sides is a foldable extension (similar to foldable extensions $\mathbf{16}_A$, $\mathbf{16}_B$, etc., each of which includes innermost fold 1 and outermost fold 2), which have been folded to respectively form three frame portions $\mathbf{22}_A$, $\mathbf{22}_B$, $\mathbf{22}_C$ and three corners $\mathbf{26}_{AB}$, $\mathbf{26}_{BC}$, $\mathbf{26}_{CA}$ shown in FIG. 4A.

It is to be understood that the innermost fold 1 of each foldable extension has opposed edges (similar to reference numbers 17 and 19 in FIG. 1A) that are perpendicular with respect to the respective side of the center portion 14 from which the foldable extension extends. The outermost fold 2 of each foldable extension has opposed edges (similar to reference numbers 21 and 23 in FIG. 1A) that are angled (e.g., at 45° and 135°, or at 22.5° and 157.5°) with respect to the respective side of the center portion 14 from which the foldable extension extends. As illustrated in FIG. 4A, the angles of the edges of the innermost folds 1 and the outermost folds 2 are selected such that when folded, adjacent edges abut one another to form frame portions $\mathbf{22}_A$, $\mathbf{22}_B$, $\mathbf{22}_C$ and corners $\mathbf{26}_{AB}$, $\mathbf{26}_{BC}$, $\mathbf{26}_{CA}$ of the three-dimensional supporting frame 20'.

The foldable material 12 used to form the triangular shaped three-dimensional supporting frame 20' also has the image receiving surface 13 and the back surface 15 that is opposed to the image receiving surface 13. An image receiving medium 36 adhered to the image receiving surface 13 is not shown in FIGS. 4A and 4B.

The blanks 28' used to form the corner mounts $\mathbf{40}_{AB}$, $\mathbf{40}_{BC}$, $\mathbf{40}_{CA}$ in FIG. 4A are circular sectors, similar to that shown in FIG. 2B. As shown in FIG. 2B, the blank 28' includes the shaped portion 30 that has two sides $\mathbf{34}_A$, $\mathbf{34}_B$ having corner mount foldable extensions $\mathbf{32}_A$, $\mathbf{32}_B$ (with tabs T1 and T2) extending therefrom, and one additional, rounded side $\mathbf{34}_C$.

The two sides $34_A$, $34_B$ of the blank 28' meet at an angle θ that is complementary to the angle of the respective corners $26_{AB}$, $26_{BC}$, $26_{CD}$ of the three-dimensional supporting frame 20'. In the example shown in FIG. 4A, the angles of the corners $26_{AB}$ and $26_{CA}$ and the complementary angle θ of the corner mounts $40_{AB}$ and $40_{DA}$ are 45° angles, while the angle of the corner $26_{BC}$ and the complementary angle θ of the corner mount $40_{BC}$ are 90° angles. The blanks 28' are folded as described above to form the corner mounts $40_{AB}$, $40_{BC}$, $40_{DA}$ shown in FIG. 4A. The adhesive layer 38 may be applied to the second surface 29 of the blanks 28' in order to adhere the corner mounts $40_{AB}$, $40_{BC}$, $40_{CA}$ to the three-dimensional supporting frame 20'.

FIG. 4B' illustrates one corner $26_{AB}$ of the triangular shaped art frame 10' with the back walls (i.e., outermost folds 2 of the three-dimensional supporting frame 20') removed for clarity. As illustrated, the corner mount $40_{AB}$ is inserted into the corner $26_{AB}$ of the three-dimensional supporting frame 20'. The tabs T2 of the corner mount $40_{AB}$ adhere to the back surface 15 of the frame 20' at respective areas of the center portion 14. The tabs T1 of the corner mount $40_{AB}$ adhere to the back surface 15 of the frame 20' at respective folds 1. While not shown due to the removal of the folds 2 in FIG. 4B, it is to be understood that portions of the shaped portion 30 adhere to the back surface 15 of the frame 20' at the folds 2.

Figure 5:
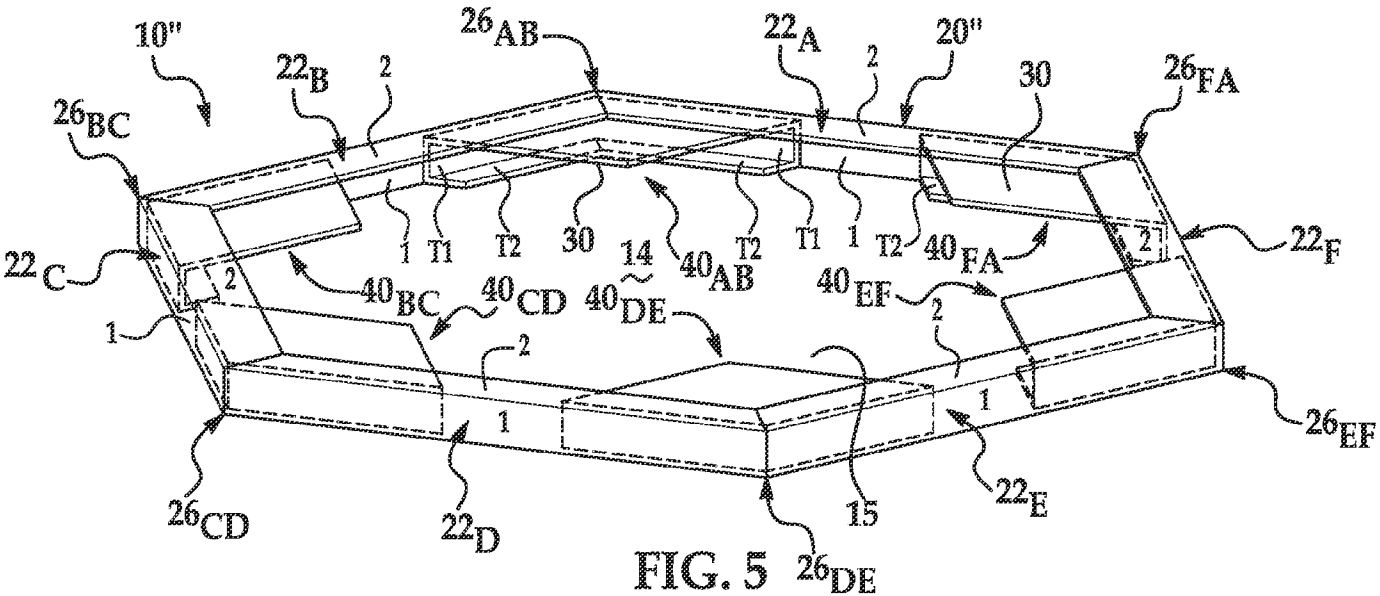
FIG. 5 is a back, perspective view of another example of an art frame.

Referring now to FIG. 5, a hexagon shaped art frame 10" is depicted. The hexagon shaped art frame 10" includes a hexagon shaped three-dimensional supporting frame 20" and corner mounts $40_{AB}$, $40_{BC}$, $40_{CD}$, $40_{DE}$, $40_{EF}$, $40_{FA}$ inserted into the respective corners $26_{AB}$, $26_{BC}$, $26_{CD}$, $26_{DE}$, $26_{EF}$, $26_{FA}$ of the three-dimensional supporting frame 20".

The foldable material 12 used to form a hexagon three-dimensional supporting frame 20" has a center portion 14 and six sides (similar to sides $14_A$, $14_B$, etc.). Extending from each of the six sides is a foldable extension (similar to foldable extensions $16_A$, $16_B$, etc., each of which includes innermost fold 1 and outermost fold 2), which have been folded to form six frame portions $22_A$, $22_B$, $22_C$, $22_D$, $22_E$, $22_F$ and six corners $26_{AB}$, $26_{BC}$, $26_{CD}$, $26_{DE}$, $26_{EF}$, $26_{FA}$ shown in FIG. 5.

It is to be understood that the innermost fold 1 of each foldable extension has opposed edges (similar to reference numbers 17 and 19 in FIG. 1A) that are perpendicular with respect to the respective side of the center portion 14 from which the foldable extension extends. The outermost fold 2 of each foldable extension has opposed edges (similar to reference numbers 21 and 23 in FIG. 1A) that are angled (e.g., at 60° and 120°) with respect to the respective side of the center portion 14 from which the foldable extension extends. As illustrated in FIG. 5, the angles of the edges of the innermost folds 1 and the outermost folds 2 are selected such that when folded, adjacent edges abut one another to form frame portions $22_A$, $22_B$, $22_C$, $22_D$, $22_E$, $22_F$ and corners $26_{AB}$, $26_{BC}$, $26_{CD}$, $26_{DE}$, $26_{EF}$, $26_{FA}$ of the three-dimensional supporting frame 20".

The foldable material 12 used to form the hexagon shaped three-dimensional supporting frame 20" also has the image receiving surface 13 and the back surface 15 that is opposed to the image receiving surface 13. An image receiving medium 36 adhered to the image receiving surface 13 is not shown in FIG. 5.

The blanks 28'" used to form the corner mounts $40_{AB}$, $40_{BC}$, $40_{CD}$, $40_{DE}$, $40_{EF}$, $40_{FA}$ in FIG. 5 are polygons, similar to that shown in FIG. 2D. The polygon shown in FIG. 2D is a square and the polygon shown in FIG. 5 is a diamond. As such, the blanks used to form the corner mounts $40_{AB}$, $40_{BC}$, $40_{CD}$, $40_{DE}$, $40_{EF}$, $40_{FA}$ include the shaped portion 30 that has two sides $34_A$, $34_B$ having corner mount foldable extensions $32_A$, $32_B$ (with tabs T1 and T2) extending therefrom, and two additional sides $34_C$, $34_D$. For each corner mount $40_{AB}$, $40_{BC}$, $40_{CD}$, $40_{DE}$, $40_{EF}$, $40_{FA}$ shown in FIG. 5, the two sides $34_A$, $34_B$ of the blank meet at an angle θ that is complementary to the angle of the respective corners $26_{AB}$, $26_{BC}$, $26_{CD}$, $26_{DE}$, $26_{EF}$, $26_{FA}$ of the three-dimensional supporting frame 20". In the example shown in FIG. 5, the angles of the corners $26_{AB}$, $26_{BC}$, $26_{CD}$, $26_{DE}$, $26_{EF}$, $26_{FA}$ and the complementary angle θ of the corner mounts $40_{AB}$, $40_{BC}$, $40_{CD}$, $40_{DE}$, $40_{EF}$, $40_{FA}$ are 120° angles. The blanks 28'" are folded as described above to form the corner mounts $40_{AB}$, $40_{BC}$, $40_{CD}$, $40_{DE}$, $40_{EF}$, $40_{FA}$ shown in FIG. 5. The adhesive layer 38 may be applied to the second surface 29 of the blanks 28" in order to adhere the corner mounts $40_{AB}$, $40_{BC}$, $40_{CD}$, $40_{DE}$, $40_{EF}$, $40_{FA}$ to the three-dimensional supporting frame 20".

As illustrated in FIG. 5, the corner mount $40_{AB}$ is inserted into the corner $26_{AB}$ of the three-dimensional supporting frame 20" and the corner mount $40_{FA}$ is inserted into the corner $26_{FA}$ of the three-dimensional supporting frame 20". The tabs T2 of the respective corner mounts $40_{AB}$ and $40_{FA}$ adhere to the back surface 15 of the frame 20" at respective areas of the center portion 14. The tabs T1 of the respective corner mounts $40_{AB}$ and $40_{FA}$ adhere to the back surface 15 of the frame 20" at respective folds 1. It is to be understood that portions of the respective shaped portions 30 adhere to the back surface 15 of the frame 20" at the respective folds 2. The other corner mounts $40_{BC}$, $40_{CD}$, $40_{DE}$, $40_{EF}$ adhere to back surface 15 at the respective corners $26_{BC}$, $26_{CD}$, $26_{DE}$, $26_{EF}$ in a similar manner.

As illustrated in the examples disclosed herein, it is to be understood that a single frame portion $22_A$, $22_B$, $22_C$, $22_D$, $22_E$, $22_F$ may have two different corner mounts 40 adhered thereto at opposed ends (i.e., at the corners formed in part by the single frame portion $22_A$, $22_B$, $22_C$, $22_D$, $22_E$, $22_F$).

In addition to being relatively simple to manufacture and assemble, the art frames disclosed herein are cost effective and light weight (at least in part because of the materials used).

It is to be understood that the ranges provided herein include the stated range and any value or sub-range within the stated range. For example, a range from about −70° C. to about −40° C. should be interpreted to include not only the explicitly recited limits of about −70° C. to about −40° C., but also to include individual values, such as −65° C., −50° C., etc., and sub-ranges, such as from about −65° C. to about −45° C., from about −50° C. to about −43° C., etc. Furthermore, when "about" is utilized to describe a value, this is meant to encompass minor variations (up to +/−10%) from the stated value.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

What is claimed is:

1. An art frame, comprising:

a three-dimensional supporting frame, including:

an image receiving surface;

a back surface opposed to the image receiving surface;

a center portion defining a perimeter; and at least three foldable extensions extending from the perimeter, each of the foldable extensions including two folds to be folded toward the back surface to form a frame portion, wherein abutting frame portions form respective corners of the three-dimensional supporting frame; and a corner mount to be inserted into a pocket defined by the abutting frame portions at the respective corners, each corner mount including:

first and second opposed surfaces;

a shaped portion;

two corner mount foldable extensions extending from two sides of the shaped portion, each of the corner mount foldable extensions including two tabs to be folded toward the first opposed surface; and an adhesive layer established on the second opposed surface, the adhesive layer to be adhered to the back surface of the three-dimensional supporting frame at the respective corners.

2. The art frame as defined in claim 1 wherein in the respective corners:

the shaped portion is to be adhered to the abutting frame portions on the back surface at an outermost of the two folds of the foldable extensions forming the abutting frame portions;

a closest one of the two tabs to the shaped portion is to be respectively adhered to an innermost of the two folds of the foldable extensions forming the abutting frame portions; and a furthest one of the two tabs to the shaped portion is to be respectively adhered to the back surface at an area of the center portion.

3. The art frame as defined in claim 1, further comprising a back support element to be mounted to each frame portion on the image receiving surface at an outermost of the two folds.

4. The art frame as defined in claim 1, further comprising a releasable liner positioned on the adhesive layer.

5. The art frame as defined in claim 1, further comprising:

an other adhesive layer established on the image receiving surface at least at the center portion; and a releasable liner positioned on the other adhesive layer.

6. The art frame as defined in claim 1 wherein the shaped portion includes an angle that is complementary to an angle of the corner of the three-dimensional supporting frame.

7. An art frame, comprising:

a three-dimensional supporting frame, including:

an image receiving surface;

a back surface opposed to the image receiving surface;

a center portion;

at least three frame portions, each of which includes two folds of a foldable extension that extends from the center portion, the two folds being folded toward the back surface; and at least three corners, each corner being formed where any two of the frame portions abut one another; and a corner mount adhered to the back surface in each of the at least three corners, each corner mount including:

a shaped portion adhered to an outermost of the two folds of each of two frame portions forming a respective corner;

a first folded extension extending from one side of the shaped portion, the first folded extension including:

a first tab closest to the shaped portion adhered to an innermost of the two folds of one of the two frame portions forming the respective corner; and a second tab furthest from the shaped portion adhered to the back surface at an area of the center portion; and a second folded extension extending from an other side of the shaped portion, the second folded extension including:

a third tab closest to the shaped portion adhered to an innermost of the two folds of an other of the two frame portions forming the respective corner; and a fourth tab furthest from the shaped portion adhered to the back surface at an other area of the center portion.

8. The art frame as defined in claim 7, further comprising:

an image receiving medium having an image printed thereon; and an adhesive adhering the image on the image receiving surface at least at the center portion of the three-dimensional supporting frame.

9. The art frame as defined in claim 7 wherein the innermost of the two folds has opposed edges that are perpendicular with respect to a perimeter of the center portion at the respective foldable extension, and wherein the outermost of the two folds has opposed edges that are angled 45° and 135° with respect to the perimeter of the center portion at the respective foldable extension.

10. The art frame as defined in claim 9 wherein each of the first and third tabs has opposed edges that are perpendicular with respect to the side of the shaped portion from which the tabs extend, and wherein each of the second and fourth tabs has opposed edges that are angled 45° and 135° with respect to a side of the shaped portion from which the tabs extend.

11. The art frame as defined in claim 10 wherein the shaped portion is an isosceles triangle and wherein the sides from which the respective tabs extend are equal in length.

12. The art frame as defined in claim 7, further comprising a back support element mounted to each frame portion on the image receiving surface at the outermost of the two folds.

13. The art frame as defined in claim 12 wherein the back support element includes a table top support structure or a wall mounting aperture.

14. The art frame as defined in claim 7 wherein the shaped portion includes at least one 90° angle.

15. The art frame as defined in claim 7 wherein the shaped portion includes an angle that is complementary to an angle of the corner of the three-dimensional supporting frame.

* * * * *